US005238044A

United States Patent [19]

Gilley et al.

[11] Patent Number: 5,238,044

[45] Date of Patent: Aug. 24, 1993

[54] WINDOW TREATMENT SUPPORT DEVICE

[76] Inventors: Paul D. Gilley; Margaret R. Gilley, both of 120 N. First St., Eufaula, Okla. 74432

[21] Appl. No.: 964,159

[22] Filed: Oct. 20, 1992

[51] Int. Cl.[5] ..... A47H 13/14

[52] U.S. Cl. ..... 160/348; 160/349.1

[58] Field of Search ..... 160/19, 38, 39, 348, 160/349.1, 349.2, 330; 211/87, 106

[56] References Cited

U.S. PATENT DOCUMENTS

| | | | |
|---|---|---|---|
| 1,537,463 | 5/1925 | Holden | 211/106 |
| 1,746,577 | 2/1930 | Berglund et al. | 160/348 X |
| 2,099,507 | 11/1937 | Wright | 211/106 |
| 2,524,426 | 10/1950 | Comerford et al. | 160/348 |
| 2,534,491 | 12/1950 | Wersching | 160/348 |
| 2,557,578 | 6/1951 | Stallone | 160/348 |
| 2,598,522 | 5/1952 | Falkenberg | 160/348 |
| 2,946,378 | 7/1960 | Nordell | 160/348 |
| 3,901,303 | 8/1975 | Falkenberg | 160/348 |
| 5,018,567 | 5/1991 | Hannerstig | 160/348 |
| 5,141,045 | 8/1992 | Williams | 160/348 |

*Primary Examiner*—David M. Purol

*Attorney, Agent, or Firm*—Paul W. Hemminger

[57] ABSTRACT

An universal window treatment support device or holder for supporting various lengths, sizes and types of curtain and/or drapery material in a wide variety of different decorative treatment arrangements. The holder is an elongated, relatively thin, flat rigid element containing a number of openings of different sizes and shapes along its length. The device is vertically mounted in front of an area to be decorated and looped sections of material is passed from the back of the holder to its front through one or more of the openings after which the looped sections are fluffed out or draped in front of the holder to provide individualized decorative treatments.

3 Claims, 2 Drawing Sheets

WINDOW TREATMENT SUPPORT DEVICE

BACKGROUND

1. Field of the Invention

The present invention relates in general to fixtures and devices for supporting and positioning window curtains and draperies and in particular to a universal support device for supporting various lengths of curtain and/or drapery material or fabric in an unlimited number of different decorative treatment arrangements.

2. The Prior Art

Curtain and drapery fixtures, traverse rods, supports, ring bars and the like are known which are designed to support, shape, arrange and position curtains or drapes in an orderly and specific manner. With these prior-art devices, little or no variation in window treatment appearance is possible except by (i) substitution of different-colored or different-lengthed curtains or drapes which would still be supported in the specific manner dictated by the design of the support elements, or by (ii) replacing the support elements with ones designed to create a specific but different window treatment appearance.

Other support devices are known which will cause unpleated curtains or drapes to assume a pleated or folded position when affixed to such supports, but again there is little variation possible in the overall appearance of the window treatment as substitute drapes will still appear pleated and folded drapes will still appear folded, even though their length or color may be changed.

SUMMARY OF THE INVENTION

The present invention resides in an elongated relatively-flat, window treatment support device having a plurality of material-receiving apertures therein and mounting means for securing the support device in a vertical position above and a spaced distance in front of a window or area to be decorated. A single length or a number of lengths, of unhemmed or finished curtain or drapery material or fabric may be simply and easily hung, arranged and displayed in a wide variety of decorative arrangements without the need for clips, pins, hooks or catches, yet such material or fabric is easily removable for washing or cleaning. This is accomplished by pulling the ends or an intermediate part of the fabric lengths through one or more material-receiving apertures in the support device and then loosely draping or fluffing out the material to conceal the support device and to create any of a number of decorative treatment arrangements.

The present invention provides a window treatment support device which will simultaneously support and display fabrics and material of different thicknesses and bulkiness by providing material-receiving apertures of different sizes and shapes through which the material may be pulled before fluffing or draping.

Still further, the present invention provides a decorative treatment support device which will support and display heavy fabrics by providing material-receiving apertures with V-shaped notches which automatically grip and hold the fabric against slippage which could occur with heavy fabrics that are not secured by clips or other retaining means.

BRIEF DESCRIPTION OF THE DRAWINGS

The present invention will be better understood from the following detailed description of several embodiments of the invention when considered in connection with the accompanying drawings in which.

DESCRIPTION OF THE SEVERAL EMBODIMENTS OF THE INVENTION

Figure 1:
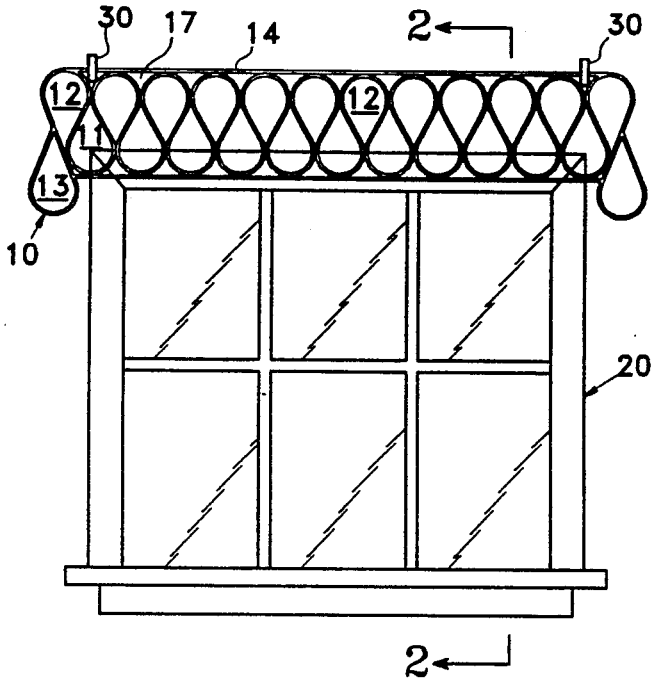
FIG. 1 is a front elevational view of the preferred embodiment of the invention shown positioned with respect to a window which will receive decorative treatment.

Referring to the drawings, the preferred embodiment of the invention shown in FIGS. 1 through 5 will now be described. In these drawings, like reference numerals will represent corresponding elements.

It is to be noted that while the preferred embodiment is described in connection with window treatments, the inventive support device is equally useful in providing decorative treatments for walls, alcoves, doorways and the like.

Figure 2:
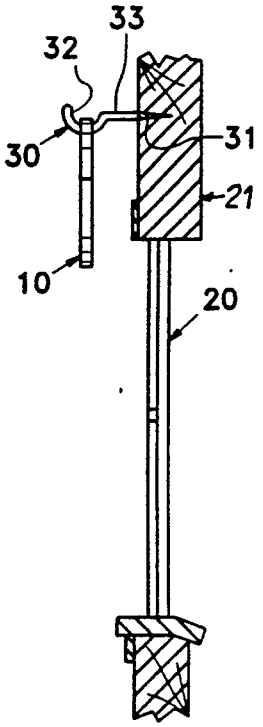
FIG. 2 taken along lines 2—2 of FIG. 1, is a side elevational view of the preferred embodiment of the invention disclosed in FIG. 1.

As best seen in FIGS. 1 and 2, the window treatment support device 10 is an elongated, relatively narrow flat structure and is shown mounted above and in front of window 20 by laterally extending mounting elements 30 having one end secured to a supporting structure such as wall 21 and the other end engaging upper rail 14 to support and maintain support device 10 in a vertical position.

While mounting element 30 is shown as a cup hook with the threaded end 31 screwed into wall 21, it could be attached to the wall by a butt plate or other securing means. Also, the semicircular hook end 32 could be V-shaped or rigidly attached to the upper rail 14 as long as support device 10 was mounted vertically. Still further, the length of shank 33 of mounting element 30 is not critical as long as it is of sufficient length to permit space for the drapery material or fabric to pass between support device 10 and wall 21. Alternatively, device 10 could be suspended from the ceiling or attached to movable floor uprights.

Figure 3:
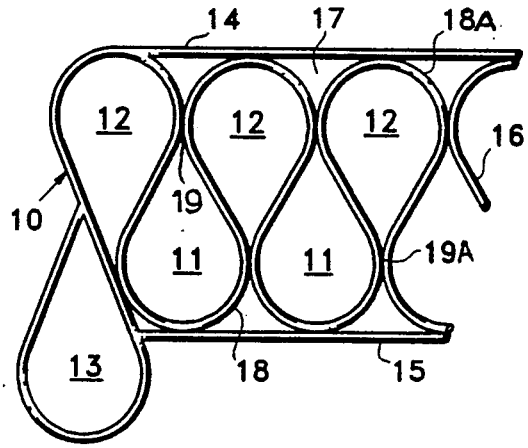
FIG. 3 is an enlarged front view of a portion of the preferred embodiment of invention.

As best seen in FIGS. 1 and 3, support device 10 comprises a first series of tear-shaped material-receiving apertures 11 arranged in side-by-side relationship with each material-receiving aperture 11 having a semicircular base 18 and an opposing V-shaped notched section 19 upwardly directed, and comprises a second series of similarly shaped material-receiving apertures 12 arranged in side-by-side relationship with each material-receiving aperture 12 having a semicircular base 18A and opposing V-shaped notched section 19A downwardly directed. A similarly shaped corner material-receiving aperture 13 with its V-shaped notched section directed upwardly is located at each end of the series of material-receiving apertures 11. The upper and lower peripheries of the flat support device 10 are bounded by respective upper and lower rails or strengthening structures 14 and 15.

Figure 6:
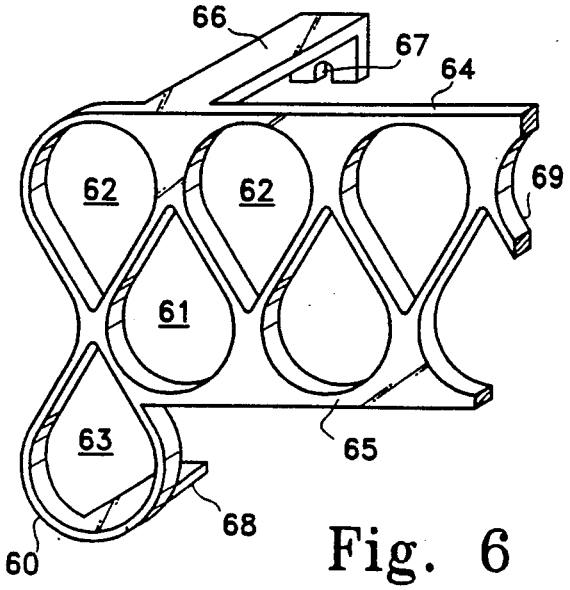
FIG. 6 is a front view of a portion of a second embodiment of the invention with integrally formed support arms.
Figure 7:
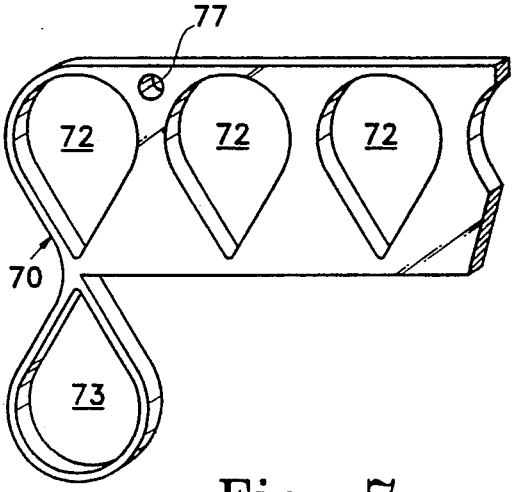
FIG. 7 is a front view of a portion of another embodiment of the invention showing a single row of material-receiving apertures.
Figure 8:
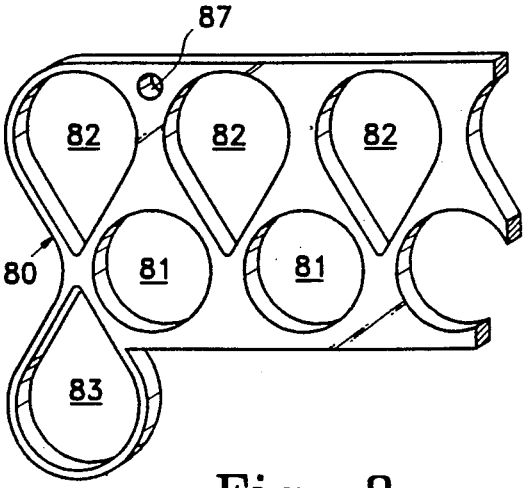
FIG. 8 is an enlarged front view of another embodiment of the invention showing two rows of differently sized and differently shaped material-receiving apertures.

It is to be noted that the rails 14 and 15 and the walls defining material-receiving apertures 11, 12 and 13 are rigidly constructed and secured together to prevent any movement therebetween. Also, while these rails and walls are shown in FIG. 3 with a circular cross-section, the entire device 10 when viewed from either end has a rectangular cross section. However, it is to be noted that the rails and walls in FIG. 3 could have square or rectangular cross-sectional shapes as shown in FIGS. 6 through 8 without departing from the spirit and scope of the invention. Also, while support device 10 is illustrated as having twenty five material-receiving apertures, the number and sizes of material-receiving apertures could be increased or decreased to fit various sized areas which might be selected to receive decorative treatment.

In the perferred embodiment, the openings 17 formed from the abutment of the walls of material-receiving apertures 12 with the upper rail 14 provide a suitable space for the semicircular hook end 32 of mounting element 30 to engage and mount support device 10 in a vertical position. When heavy drapery fabric or material is used, additional mounting elements 30 may be used to engage upper rail 14 intermediate its ends to prevent any possible distortion of support element 10 from the weight of the fabric.

Figure 4:
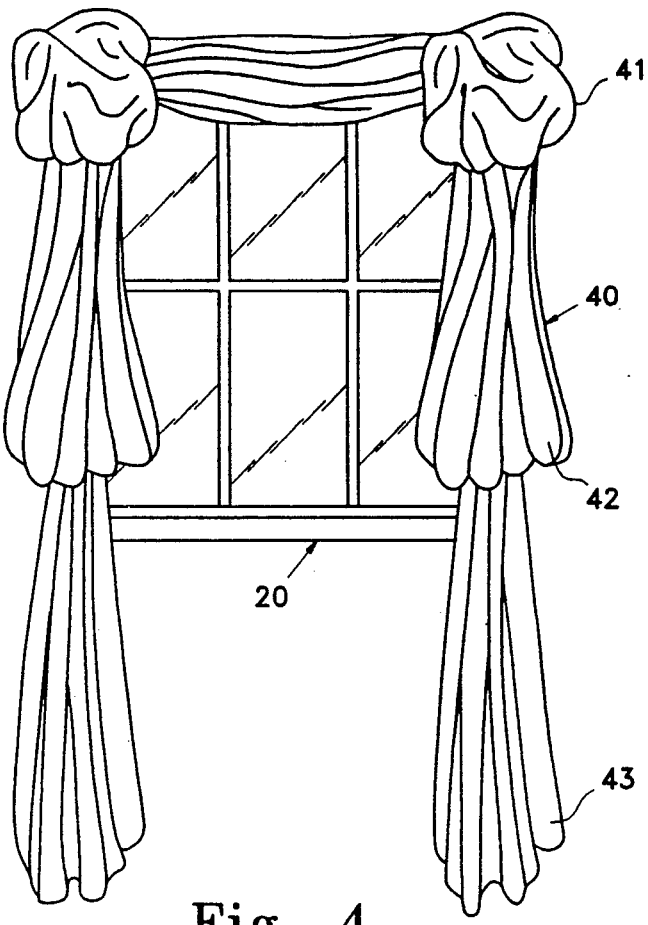
FIG. 4 is a front view of a pictorial representation of the window area in FIG. 1 decorated with fabric or drapery supported on the inventive support device.
Figure 5:
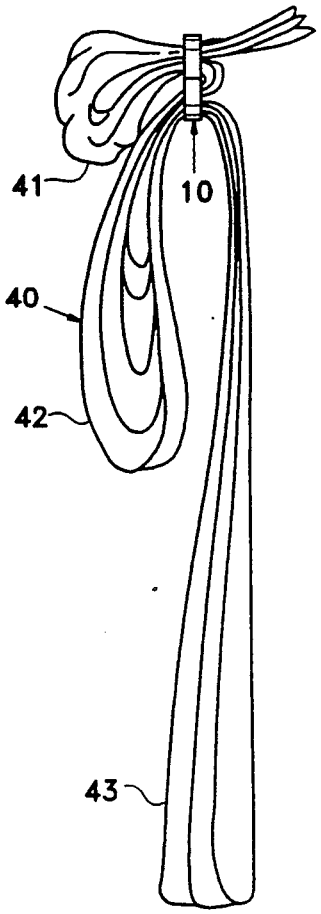
FIG. 5 is a side view of a pictorial representation of the window treatment shown in FIG. 4.

Referring now to FIGS. 4 and 5, a brief description will be given of one example of the use of the inventive device for decorative treatment of the window shown in FIG. 1.

In the particular treatment being described, the length of the fabric 40 to be used is generally determined by adding the lengths of the two sides and top of the treatment being planned, plus approximately one foot for each material-receiving aperture 11 or 12 that will be used, plus approximately one yard for each corner of the window treatment. The decorator will maintain the middle of the selected length of material in the center of support device 10 and will pass one foot of looped material from the back of device 10 to the front thereof through an end material-receiving aperture 12 and then pass one yard of looped material through the adjacent corner material-receiving aperture 13. The remaining material on the half-length that is being arranged will hang or drape in folds 43 or puddle on the floor. The other half-length of the material 40 is similarly looped through the other end material-receiving aperture 12 and corner material-receiving aperture 13. The material looped through material-receiving apertures 12 is billowed out to form ruffle 41 and the material looped through material-receiving apertures 13 is arranged in the form of draped sleeves 42. Finally, slight adjustments are made to provide symmetry between both sides of the decorative treatment.

While two or more contrasting types of fabric can be used, only one type of fabric is illustrated and while numerous of the other material-receiving apertures 11 and 12 can be used to support the fabric, only the corner material-receiving apertures 13 and immediately adjacent material-receiving apertures 12 are used in the FIG. 4 and FIG. 5 pictorial representation. However, it can be seen that an unlimited number of decorative treatments can be created by using different ones of the material-receiving apertures and arranging the looped material in different lengths and forms.

Referring now to FIG. 6 of the drawings, a second embodiment of the invention will be described.

The window treatment support device 60 differs from support device 10 of FIG. 1 in that the walls between adjacent material-receiving apertures of support device 60 are of a rectangularly-shaped cross-sectional configuration and in that the mounting bracket 66 and stablizing bracket 68 are an intergal part of the upper and lower rail sections 64 and 65.

The window treatment support device 60 is mounted on the wall or window area by hooking notch 67 over a nail or screw which is appropriately secured to the wall. The stablizing bracket 68 aids in maintaining the support device in a vertical position, and if desired, the free end thereof may be rigidly secured to the wall. The material-receiving apertures 61, 62 and 63 of FIG. 6 are tear-shaped with a semicircular base and opposing V-shaped notch and are arranged in side-by-side relationship, all as described in connection with respective material-receiving apertures 11, 12 and 13 of FIG. 3.

A support device 70, shown in FIG. 7, is specifically designed for window treatments using heavy or bulky material in that only one series of side-by-side material-receiving apertures 72 are provided and such apertures have their V-shaped notches downwardly extending. As previously pointed out, the weight of the free ends of heavy or bulky fabric will tend to pull the short looped portions out of the material-receiving apertures. This problem has been overcome by providing the material-receiving apertures with the noted V-shaped notches which wedge portions of the fabric together and thus prevent easy retraction of the looped material unless it is deliberately moved out of the gripping notch. The longer looped length of fabric used to form sleeves has relatively equal weight on both sides of material-receiving aperture 73 so that the looped fabric has little tendency to pull out of its captivating aperture. While window treatment support device 70 shows an opening 77 for receiving, for example, a hook end such as shown on mounting bracket 30 of FIG. 3, it is to be understood that device 70 could have a mounting bracket similar to bracket 66 of FIG. 6.

Some window treatments may use two or more fabrics with different prints, colors or weaves, or such window treatments may use heavy fabrics together with sheer fabrics. The window treatment support device 80 shown in FIG. 8 is specifically designed for supporting both heavy-weight and light-weight material. As pointed out in connection with the description of support device 70, the loop-receiving apertures 72 with downwardly extending V-shaped notches securely hold heavy fabrics in position. Thus, window treatment support device 80 contains a series of side-by-side loop-receiving apertures 82 for receiving heavy or bulky fabrics. Support device 80 also includes a series of side-by-side loop-receiving apertures 81 of generally circular configeration through which light-weight or sheer material may be looped without the tendency of the loops to be pulled out of their apertures as the free ends of such material does not exert much downward force.

The circular apertures 81 encompass less area that the tear-shaped apertures 82 and thus less opening is visible when a small volume of sheer fabric is passed therethrough.

While several embodiments of the invention have been disclosed and described, it is to be understood that numerous changes may be made to the inventive device without departing from the scope and spirit of the invention as set out in the appended claims.

What is claimed is:

1. A window treatment support device for holding and supporting drapery and curtain materials in a wide variety of non-uniform decorative treatment arrangements comprising in combination;

an elongated non-expansible rigid member of a generally rectangular cross-sectional configuration having at least one flat surface thereon;

mounting means for positioning and maintaining said elongated rigid member a spaced distance in front of an area to be decorated with the flat surface of said elongated rigid member lying in a vertical plane;

said elongated rigid member having a plurality of material-receiving apertures spaced along the length thereof with each material-receiving aperture extending through the said elongated rigid member at right angles to the flat surface thereof and with each material-receiving aperture having a separate continuous side wall; and each end of said elongated rigid member having a downwardly extending section with a flat surface thereon lying in said vertical plane with each said downwardly extending section having a material-receiving aperture extending therethrough at right angles to the flat surface thereof.

2. A window treatment support device for holding and supporting drapery and curtain materials in a wide variety of non-uniform decorative treatment arrangements comprising in combination;

an elongated non-expansible rigid member of a generally rectangular cross-sectional configuration having at least one flat surface thereon;

mounting means for positioning and maintaining said elongated rigid member a spaced distance in front of an area to be decorated with the flat surface of said elongated rigid member lying in a vertical plane;

said elongated rigid member having a plurality of material-receiving apertures extending therethrough at right angles to the flat surface thereof and arranged in first and second rows along the length thereof with each material-receiving aperture having a separate continuous side wall; and said side walls of each material-receiving aperture in the said first row having a downwardly directed V-shaped wall section and the side walls of each material-receiving aperture in the said second row having an upwardly directed V-shaped wall section.

3. A window treatment support device for holding and supporting drapery and curtain materials in a wide variety of non-uniform decorative treatment arrangements comprising in combination;

an elongated non-expansible rigid member of a generally rectangular cross-sectiohal configuration having at least one flat surface thereon;

mounting means for positioning and maintaining said elongated rigid member a spaced distance in front of an area to be decorated with the flat surface of said elongated rigid member lying in a vertical plane;

said elongated rigid member having a plurality of material-receiving apertures extending therethrough at right angles to the flat surface thereof and arranged in first and second rows along the length thereof with each material-receiving aperture having a separate continuous side wall; and said side walls of each material-receiving aperture in the said first row having a downwardly directed V-shaped wall section and the side walls of each material-receiving aperture in the said second row having an upwardly directed V-shaped wall section, with the said downwardly directed V-shaped wall sections and the said upwardly directed V-shaped wall sections arranged in side-by-side relationship.

* * * * *